US005785568A

United States Patent [19]

Lake

[11] Patent Number: 5,785,568

[45] Date of Patent: Jul. 28, 1998

[54] LIFE PRESERVER/CUSHION

[76] Inventor: Randy Lake, 9285 Virginian La., La Mesa, Calif. 91941

[21] Appl. No.: 845,195

[22] Filed: Apr. 21, 1997

[51] Int. Cl.[6] ..... A45C 9/00

[52] U.S. Cl. ..... 441/127; 441/115

[58] Field of Search ..... 441/80, 88, 115, 441/114, 106, 116, 117, 125–127

[56] References Cited

U.S. PATENT DOCUMENTS

| | | | |
|---|---|---|---|
| 1,200,858 | 10/1916 | Linder | 441/115 |
| 2,132,544 | 9/1938 | Shaw | 441/115 |
| 3,167,794 | 2/1965 | Brown | 9/338 |
| 3,565,486 | 2/1971 | Channon | 297/445 |
| 3,903,554 | 9/1975 | Dodd | 9/297 |
| 4,287,250 | 9/1981 | Rudy | 428/166 |
| 4,472,151 | 9/1984 | Hoffman | 441/127 |
| 4,619,623 | 10/1986 | Elverskog | 441/126 |
| 4,822,309 | 4/1989 | Vandenberg | 441/35 |
| 5,335,882 | 8/1994 | Bonacci | 244/118.5 |

FOREIGN PATENT DOCUMENTS

| | | | |
|---|---|---|---|
| 0192021 | 1/1923 | United Kingdom | 441/115 |

*Primary Examiner*—Ed Swinehart

*Attorney, Agent, or Firm*—Brown, Martin, Haller & McClain

[57] ABSTRACT

A life preserver/cushion that has flotation panels which may be releasably secured together to form a seat cushion and when so secured the life preserver/cushion also serves as a tossable flotation device. A fabric interconnecting panel with a hand opening is stowed between the panels. The flotation panels are separated for use as a wearable life preserver. The interconnecting panel is received over the users head. Straps and buckles on the life preserver surfaces are used to secure the device around the users trunk.

7 Claims, 2 Drawing Sheets

LIFE PRESERVER/CUSHION

BACKGROUND OF THE INVENTION

It has for many years been recognized that the risk of drowning for recreational boaters, even for experienced swimmers, is dramatically reduced if the passenger is able to put on a life preserver upon entering the water. Conventional life preservers are cumbersome to wear and not readily stowed so that they are close at hand when the need arises. A second, and related risk of drowning occurs when a person is ejected from a boat or other vessel and it becomes necessary for persons on the vessel to deliver flotation to a person in the water. One of the devices utilized to answer this requirement is a so-called "tossable" flotation device. At the same time, it has long been recognized that the risk of drowning increases as the size of the vessel decreases. The vast majority of persons drowning from these vessels did not have the use of a flotation device. However, Coast Guard and other safety requirements for smaller vessels have typically been more relaxed than those for larger vessels in recognition of the limited cargo carrying capability and stowage space available on many smaller vessels, including auxiliary dinghies and lightweight sailboats. The constricted space of these vessels, and the requirement for the passengers and crew to be actively involved in propelling, steering or sail-handling of these vessels makes it desirable to have a lifesaving device which may be accommodated within the space available on a small vessel, or to conserve space on a larger vessel, and which makes it practical to keep a life preserver/cushion readily at hand, especially where such life preserve/cushion can also perform the functions of a tossable flotation device.

SUMMARY OF THE INVENTION

The disadvantages of prior art life preservers are overcome in the present invention which provides a life preserver/cushion which can serve as a seat cushion attached over a seat board, used by passengers as a conventional cushion, or stowed close at hand in the vessels cockpit, so that the life preserver/cushion is readily available if it is necessary to abandon the vessel, and readily available for tossing to a person in the water. In accordance with the invention, the life preserver/cushion overcomes the deficiencies of prior art devices in a device that is readily convertible, even by a person in the water to whom the device is tossed, into a full-featured, Class 3-capable life preserver, and which may be donned and secured around the user rapidly so as to provide long-term flotation, and to float the user chest-up while awaiting rescue.

In an exemplary embodiment of the invention, the advantages are achieved in a device with two flotation panels which may be positioned to overlie one another and to be substantially co-extensive one with the other, and which may be releasably secured, one panel or the other, so as to form a seat cushion configuration that is comfortable to use for seating, and which also provides a high degree to flotation when tossed to a person in the water. An interconnecting web, which may be in the form of straps, or in the form of a fabric panel with a head opening, is attached between the flotation panels, preferably adjacent the outer surface of the flotation panels, and which may be folded and stowed between the panels when the device is not in use. Straps are secured, preferably on the seating surfaces of the panels, and incorporate releasable fasteners such as buckles or other suitable interconnection devices so that when donned by the user, with the head between the web portions or panel head opening, the buckles are directly in front of the wearer and may be rapidly secured.

BRIEF DESCRIPTION OF THE DRAWINGS

Referring now to the drawings in which like reference numerals refer to like parts throughout and in which.

DESCRIPTION OF THE PREFERRED EMBODIMENT

Figure 1:
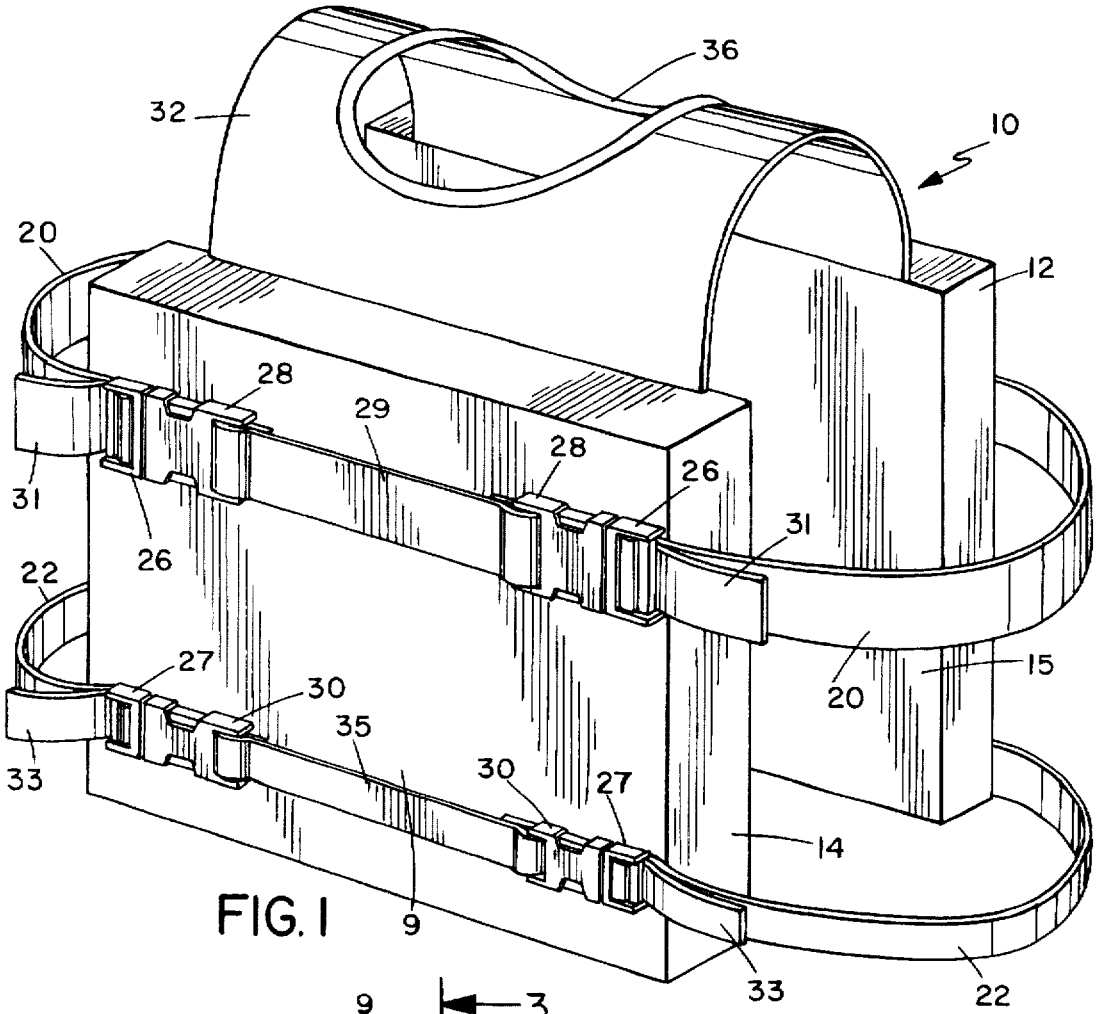
FIG. 1 is a perspective view of the unit in open, life preserve configuration.
Figure 2:
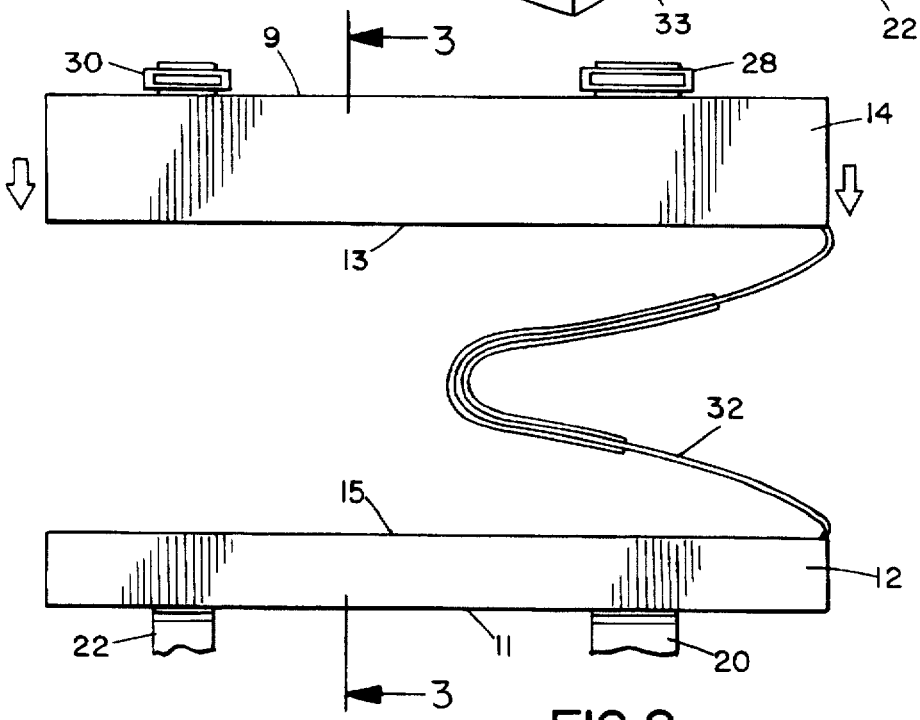
FIG. 2 is an enlarged side elevation view showing the unit partially closed.

Referring to FIGS. 1 and 2 there is illustrated a life preserver/cushion 10 according to the preferred embodiment of the invention. Flotation panels 12 and 14 are shown to have planar rectangular surfaces including inner surfaces 13 and 15 and life preserver surface 9 and 11. Other generally planar shapes, are possible within the scope of the invention. The flotation panels' surfaces 9 and 11 are sized to be substantially co-extensive so that when secured together as a cushion (see FIG. 3) they function as an integrated unit with the combined thickness of the two individual cushions. The panel 14 which serves as flotation for the chest is approximately twice the thickness of the panel 12. The extra flotation in the chest area results in the user being supported in a face up orientation.

A web 32 with a neck opening 36 serves to connect the panels 12 and 14 and to position the panels vertically in the correct position on the user's torso.

An upper strap 20 is sized to encircle a user. The strap 20 is positioned on panel 12 by strap loops 23 (FIG. 3) sewn to the surface 9. The strap ends 31 are received through buckle tangs 26. The buckle tangs may be releasably secured in buckle receptacles 28. A fixed strap 29 is sewn to the life preserver surface 9 and functions to transfer the strain on strap 20 between the buckle receptacles 28, without substantially stressing the flotation panel 14.

Lower strap 22 is secured and functions in a manner like strap 20. The strap may be narrower in width since its function of holding the lower ends of the panels 12 and 14 against the user's body does not introduce major stresses. The strap ends 33 are received through buckle tangs 27. The buckle receptacles 30 are interconnected by fixed strap 35.

Figure 3:
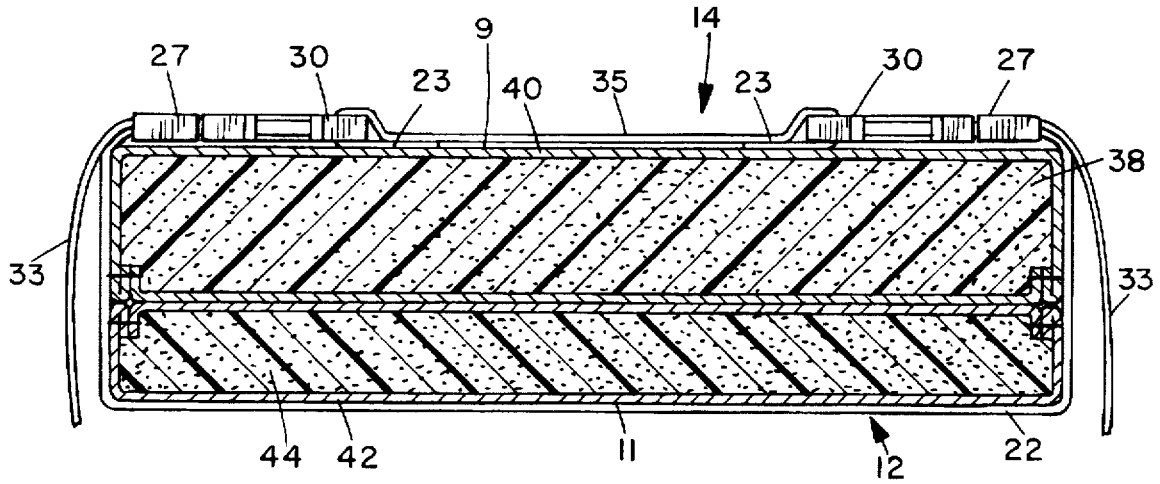
FIG. 3 is a sectional view taken on line 3—3 of FIG. 2.

FIG. 3 shows a sectional view of flotation panels 12 and 14, taken on line 3—3 of FIG. 2. Panel 14 includes flotation foam 38 enclosed by fabric envelop 40. Similarly, panel 12 includes flotation foam 42 enclosed by fabric envelop 44. Upper and lower straps 20 and 22 are positioned respectively on surfaces 9 and 11. Preferably, the flotation foam 38 in the the flotation panel 14 is substantially greater than the thickness of the flotation foam 44 in the flotation panel 12. A good choice is to construct the flotation panel 14 to be approximately twice the thickness of the flotation panel 12.

Figure 4:
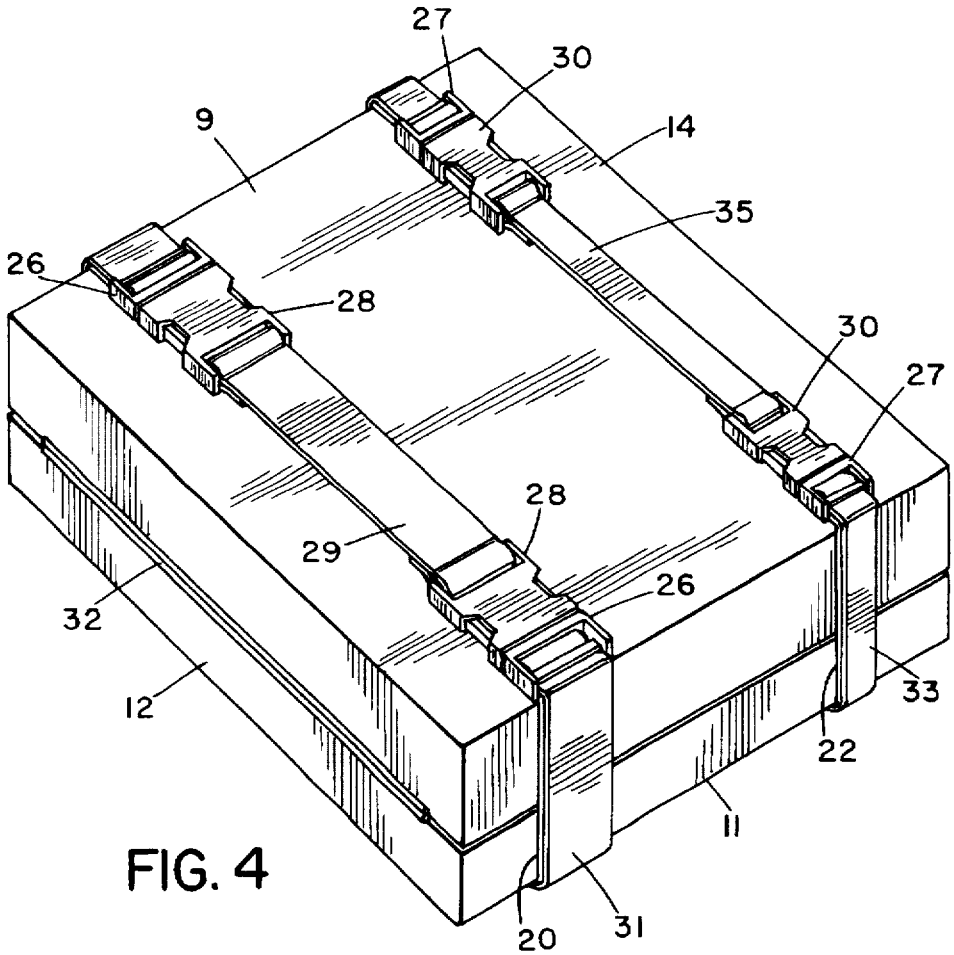
FIG. 4 is a perspective view of the unit closed in the cushion configuration.

Referring now to FIGS. 2 and 4, the configuration of the life preserver/cushion that supports its use as a seat cushion is illustrated. The interconnection web 32 is folded between the flotation panels 12 and 14 with the buckles on the flotation panels facing outwardly. The outward placement of the buckles make the life preserver/cushion's function as a life preserver immediately apparent. This configuration also makes the straps accessible to be grasped by a person in the water to whom the device is tossed.

The life preserver/cushion may also be stowed and secured over a seat board, such as in a dinghy. In operation, the cushion is preferably positioned such that the stationery board is received between the folded web 32 and the surface of the panels. The respective tangs and receptacles on the upper and lower straps are then buckled together to secure the life preserver to the seat board. In this manner, the user is assured that the life preserver/cushion will be close at hand if needed. The life preserver/cushion may be removed from the seat by simply unbuckling the respective straps and tossing the life preserver/cushion to a person in the water.

The structure of the life preserver/cushion which supports its use as a life preserver may best be seen in FIG. 1. Donning of the life preserver/cushion may be accomplished in the water, after the user has stabilized themselves in the water and is not in immediate danger. The snaps are released and the straps extended. The flotation panels are separated to unfurl the web 32. The user inserts their head through the opening 36 and grasps the free ends 26 and 27 of the buckles, drawing the straps 20 and 22 around the user's trunk and inserting them into the buckle receptacles 28 and 30. The fit of the life preserver/cushion may then be adjusted by drawing in on the free ends 31 and 33. The web 32 may be alternatively replaced by a pair of shoulder straps (not shown).

Having described my invention I claim:

1. A life preserver/cushion comprising:

a first flotation panel having a generally planar seating surface, a second generally planar flotation panel connected to the first flotation panel by an interconnecting web; said second flotation panel being sized to be substantially co-extensive with said first flotation panel when positioned to overlie said first flotation panel, at least one strap and strap fastener secured to the first and second flotation panels and forming a continuous strap when said strap and strap fastener are connected for encircling a user when the first flotation panel is positioned on the user's chest and the second flotation panel is positioned on the user's back, and said interconnecting web being secured proximate an edge on each of said panels, and having shoulder strap portions and at least one opening sized to accommodate user's head, said interconnecting web being adapted to be folded and stored between said panels when the panels are in an overlying relationship.

2. The life preserver/cushion of claim 1 wherein:

said web and shoulder strap portions comprise a panel of fabric with a centrally located opening sized to accommodate the user's head.

3. The life preserver/cushion of claim 1 wherein:

each cushion comprises a thickness of flotation foam within a fabric envelope.

4. The life preserver/cushion of claim 1 wherein:

said first flotation panel has a thickness of flotation foam that is substantially greater than the thickness of the thickness of foam in said second flotation panel.

5. The life preserver/cushion of claim 4, wherein:

said first flotation panel is approximately twice the thickness of said second flotation panel.

6. The life preserver/cushion of claim 1 wherein said strap fastener is located proximate to said first panel.

7. A method of use of a life preserver cushion wherein the life preserver/cushion incorporates a first flotation panel with a seating surface and an outer surface, a second flotation panel connected to the first flotation panel in a folding and hinging relationship with said first flotation panel; at least one strap and strap fastener secured to the first and second flotation panels for encircling a user when the first flotation panel is positioned on the user's chest and the second flotation panel is positioned on the user's back; said strap fastener being proximate to said first panel; an interconnecting web proximate an edge on each of said panels, said web having shoulder strap portions and at least one opening sized to accommodate user's head; comprising the steps of:

stowing said interconnecting web between said flotation panels;

securing said first flotation panel to said second flotation panel in overlying relationship;

tossing said life preserver/cushion to a person in the water;

donning said life preserver by lowering said first panel over the front of a person's body and said second panel over the rear of a person's body and inserting the person's head through said opening in said interconnecting web.

* * * * *